US007354547B2

(12) United States Patent
Ukaji et al.

(10) Patent No.: US 7,354,547 B2
(45) Date of Patent: Apr. 8, 2008

(54) MOLTEN-METAL TRANSFERRING LADLE AND MOLTEN-METAL TAPPING METHOD

(75) Inventors: Bunji Ukaji, Aichi (JP); Kenji Ogawa, Osaka (JP); Toshiyuki Matsumoto, Aichi (JP); Akira Nishihira, Osaka (JP); Katsuyoshi Mukai, Osaka (JP)

(73) Assignees: Nippon Crucible Co., Ltd., Tokyo (JP); Daiki Aluminum Industry Co. Ltd., Osaka (JP)

( * ) Notice: Subject to any disclaimer, the term of this patent is extended or adjusted under 35 U.S.C. 154(b) by 0 days.

(21) Appl. No.: 11/331,543

(22) Filed: Jan. 13, 2006

(65) Prior Publication Data

US 2006/0119024 A1 Jun. 8, 2006

Related U.S. Application Data

(63) Continuation of application No. PCT/JP2004/010901, filed on Jul. 23, 2004.

(30) Foreign Application Priority Data

Jul. 25, 2003 (JP) ..... 2003-279746
Oct. 10, 2003 (JP) ..... 2003-351645

(51) Int. Cl.
*C21C 7/00* (2006.01)

(52) U.S. Cl. ..... 266/220; 266/239; 222/595

(58) Field of Classification Search ..... 266/217, 266/220, 239; 222/595
See application file for complete search history.

(56) References Cited

U.S. PATENT DOCUMENTS 3,810,564 A * 5/1974 Allyn et al. ..... 222/595
4,169,584 A * 10/1979 Mangalick ..... 266/220
4,395,026 A * 7/1983 Hodl et al. ..... 266/220
5,271,539 A * 12/1993 Ozawa et al. ..... 266/239

FOREIGN PATENT DOCUMENTS

| | | | |
|---|---|---|---|
| JP | 2002-052164 | 2/1990 | |
| JP | 404187359 A * | 7/1992 | ..... 164/306 |
| JP | 2001-287021 | 10/2001 | |
| JP | 2002-254158 | 9/2002 | |
| JP | 3323489 B | 9/2002 | |
| JP | 3492677 B | 2/2004 | |
| WO | WO 02/051740 A1 | 7/2002 | |

OTHER PUBLICATIONS

International Search Report form PCT/ISA/210 dated Nov. 22, 2004, in two pages.

* cited by examiner

*Primary Examiner*—Scott Kastler
(74) *Attorney, Agent, or Firm*—Knobbe, Martens, Olson & Bear, LLP

(57) ABSTRACT

A pressure tapping type ladle for transferring molten-metal includes a ladle body for containing molten metal, a top cover covering a top opening of the ladle body, and an openable working cover covering an opening formed in a part of the top cover. The ladle also includes a molten-metal tapping portion extending from a lower portion of the ladle body to above the ladle body, wherein the working cover is equipped with a cover body covering the opening of the top cover, a gas inlet formed in a top panel of the cover body, and a heat-resistant layer provided inside the cover body. The heat-resistant layer is comprised of a gas-permeable fireproof material layer, and gas for pressurizing inside the ladle body is introduced from the gas inlet via the gas-permeable fireproof layer.

14 Claims, 10 Drawing Sheets

Prior Art

MOLTEN-METAL TRANSFERRING LADLE AND MOLTEN-METAL TAPPING METHOD

CROSS-REFERENCE TO RELATED APPLICATIONS

This application is a continuation of PCT Patent Application No. PCT/JP2004/010901 filed on Jul. 23, 2004 which claims priorities of Japanese Patent Application No. 2003-279746 filed on Jul. 25, 2003 and of Japanese Patent Application No. 2003-351645 filed on Oct. 10, 2003, the disclosures of which are incorporated herein in their entirety by reference.

BACKGROUND OF THE INVENTION

1. Field of the Invention

The invention relates to a pressure tapping type ladle for transferring molten metal and a molten-metal tapping method for use in transferring and supplying molten metal, such as molten aluminum, to a molten-metal holding furnace placed in a molten-metal casting facility.

2. Description of the Related Art

In manufacturing castings of aluminum or aluminum alloy by a die casting method, the casting is usually performed at a plant equipped with many die-casting machines in order to increase productivity. Molten metal is supplied to a die-casting machine by transferring molten metal from a molten-metal holding furnace to a molten-metal ladle, and then supplying molten metal from the molten-metal ladle. Since a predetermined amount of molten metal always needs to be retained in a molten-metal holding furnace, molten metal obtained from a melting furnace located in the plant or molten metal brought from the outside of a plant is continuously supplied thereto so that a predetermined amount of molten metal may be maintained.

FIGS. 14A and 14B are cross-sectional views of one example of a conventional pressure tapping molten-metal transferring ladle. FIG. 14A shows an entire molten-metal transferring ladle and FIG. 14B is a view when the working cover is open. The molten-metal transferring ladle shown in FIGS. 14A and 14B comprises: a ladle body 101 for holding molten metal; a top cover 102 covering the ladle body; an openable working cover 103 provided in the top cover 102; a gas inlet 104 that is provided in the working cover 103 and pressurizes the surface of the molten metal (molten-metal surface) in the ladle; and a molten-metal tapping portion 105 provided in the ladle body 101.

The working cover 103 covers an opening 111 for use in pouring molten metal to the ladle body 101, removing scum (aluminum oxide, etc.) formed on the molten-metal surface, measuring the molten-metal temperature, etc. The outer surfaces of the ladle body 101, the top cover 102, and the working cover 103 are usually covered with steel shells 107, 108, and 109, respectively. The insides of the ladle body 101, the top cover 102, and the working cover 103 are laminated with a fireproof material 110. Furthermore, in order to raise the heat insulating property, a heat insulating material, etc., may be laminated between the fireproof material 110 and each of the outer steel shells 107, 108, and 109. In order to control the molten-metal tapping rate or to stop the pressurizing, a gas outlet 113 for discharging introduced gas is provided.

For tapping molten metal, a gas, such as air, is introduced through an opening 112 from the gas inlet 104 to pressurize the molten-metal surface, thereby supplying molten metal to a molten-metal holding furnace from a tap hole 106. In the conventional tapping method of inclining a ladle, and then pouring molten metal to a holding furnace while controlling the molten-metal tapping rate, advanced skill is required and the workload is increased for conducting the same procedure at a plurality of molten-metal holding furnaces. By tapping molten metal by pressurizing a molten-metal surface as described above, such disadvantageous operations can be eliminated.

As described above, molten metal may be supplied to a molten-metal holding furnace located inside a casting plant from a metal-melting plant located outside the plant. In this case, a molten-metal transferring ladle containing the molten metal is transported by a truck or like conveyance. When a truck, etc., travels on a public road, the molten-metal surface may shake greatly due to the roughness of the road surface or the curves at street corners. This may accidentally splash molten metal, which will adhere to the inner surface of the top cover 102 or the working cover 103.

FIGS. 14A and 14B show a molten-metal transferring ladle in which the gas inlet 104 is formed in the working cover 103 (e.g., Japanese Patent No. 3323489). In the prior-art molten-metal transferring ladle, in which the gas inlet 104 is not formed in the working cover 103, the gas inlet 104 is provided mainly in the top cover 102. In the case of the molten-metal transferring ladle shown in FIGS. 14A and 14B, since an opening 112 of the gas inlet 104 is formed in the working cover 103, which can be provided at a longer distance from the molten-metal surface, the frequency with which the opening is clogged with molten metal or molten-metal splashes is reduced compared with the case where the gas inlet 104 is formed in the top cover 102.

Forming the gas inlet 104 in the working cover 103 reduces the frequency of clogging of the opening of the gas inlet due to molten-metal splashes to some extent. However, it cannot be said that the clogging of the opening is completely prevented considering the fact that clogging may occur due to road surface conditions, the type of conveyance, such as a truck, the amount of molten metal, etc. The clogging of the opening 112 hinders the tapping of molten metal, and in the worst case, the clogging makes it difficult to pour the molten metal.

SUMMARY OF THE INVENTION

Embodiments have been made to solve the above-described problems, and aim to provide a pressure tapping type ladle for transferring molten metal and a molten-metal tapping method, which can reliably introduce a pressurizing gas.

In order to achieve the above-described objects, a pressure tapping type ladle for transferring molten-metal (1) comprises: a ladle body for containing molten metal; a top cover covering a top opening of the ladle body; an openable working cover covering an opening formed in a part of the top cover; and a molten-metal tapping portion extending from a lower portion of the ladle body to above the top cover; wherein the working cover is equipped with a cover body covering the opening of the top cover from above, a gas inlet formed in a top panel of the cover body, and a heat-resistant layer provided inside the cover body; the heat-resistant layer is comprised of a gas-permeable fireproof material layer; and gas for pressurizing inside the ladle body is introduced from the gas inlet via the gas-permeable fireproof layer.

In a molten-metal transferring ladle (2), the heat-resistant layer in the molten-metal transferring ladle (1) is comprised of a gas-permeable heat-insulating material layer between the gas-permeable fireproof material layer and the gas inlet.

In a molten-metal transferring ladle (3) of the invention, the heat-resistant layer in the molten-metal transferring ladle (1) is comprised of a heat-insulating material layer having a gas flow portion between the gas-permeable fireproof material layer and the gas inlet.

In molten-metal transferring ladles (4) to (6), the working cover in any one of the molten-metal transferring ladles (1) to (3) is provided with a space serving as a gas reservoir between the gas inlet and the gas-permeable fireproof material layer, the gas-permeable heat-insulating material layer, or the heat-insulating material layer.

In a molten-metal transferring ladle (7), the working cover of the molten-metal transferring ladles (1) is provided on the gas-permeable fireproof material layer surface facing the ladle body with a metal support that supports the gas-permeable fireproof material layer and that has gas permeability.

In a molten-metal transferring ladle (8), the working cover in the molten-metal transferring ladle (7) is provided with a gas-permeable fireproof material cover covering the metal support on the metal support surface facing the ladle body.

In a molten-metal transferring ladle (9), the working cover in any one of the molten-metal transferring ladles (1) is provided on the gas-permeable fireproof material layer surface facing the ladle body with a metal support that supports the gas-permeable fireproof material layer and that has an opening for ventilation and the metal support is provided, at a distance, with a plate for protecting the opening for ventilation under the opening for ventilation.

In a molten-metal transferring ladle (10), the plate for protecting the opening for ventilation in the molten-metal transferring ladle (9) inclines downward from the center to the outside.

In a molten-metal transferring ladle (11), the working cover in any one of the molten-metal transferring ladles (1) is equipped with a gas outlet for discharging gas from the ladle body.

A method for tapping molten metal comprising: pouring molten metal into the ladle body of any one of the molten-metal transferring ladles (1) to (11), substantially sealing the ladle body with the top cover or the working cover, and introducing a pressurizing gas from the gas inlet via the gas-permeable fireproof material layer to pressurize the surface of the molten metal, thereby tapping molten metal from the molten-metal tapping portion.

According to the above-described molten-metal transferring ladle (1), the gas-permeable fireproof material layer, which is a heat-resistant layer of the working cover, occupies a large area relative to the ladle body. In other words, the gas-flowing area of the gas-permeable fireproof material layer is large. Therefore, even when the gas-permeable fireproof material layer is partially clogged, gas can flow through non-clogged parts of the layer. Therefore, pressurizing gas is supplied to the molten-metal transferring ladle without any trouble, and thus, molten metal is generally poured with no difficulties. In the case where the gas inlet not only introduces gas into the molten-metal transferring ladle but also discharges gas therefrom, the gas discharge is rarely hindered.

According to the above-described molten-metal transferring ladle (2) or (3), since the working cover is provided with the heat-insulating material layer, heat dissipation from the working cover can be lessened. This can suppress any drop in the molten metal temperature in the molten-metal transferring ladle.

According to the above-described molten-metal transferring ladle (4), (5) or (6), a space for a gas reservoir is provided between the gas-permeable fireproof material layer or the gas-permeable heat-insulating material layer and the gas inlet. Therefore, even when the provided fireproof material layer or heat-insulating material layer has low gas permeability, the region of the layer corresponding to the part facing the space can serve as a gas-permeable layer. This makes it possible to enlarge the effective gas flow area, as compared with the case where such space is not provided. Moreover, even if the gas-permeable fireproof material layer is partially clogged, the required quantity of gas can be supplied or discharged.

According to the above-described ladle for transferring molten metal (7), the working cover is provided on the gas-permeable fireproof material layer surface facing the ladle body with a gas-permeable metal support supporting the gas-permeable fireproof material layer. This can prevent the gas-permeable fireproof material layer from falling, and can also support, if used, a gas-permeable fireproof material layer comprised of spherical fire refractory materials.

Moreover, the above-described ladle for transferring molten metal (8) is provided with a gas-permeable fireproof material cover which covers the above-described metal support. This can prevent the metal support from being weakened or damaged by reaction with adhered molten metal (aluminum, aluminum alloy, etc.).

Moreover, according to the above-described ladle for transferring molten metal (9), the working cover is provided with a metal support that supports the gas-permeable fireproof material layer and has a ventilation opening on the gas-permeable fireproof material layer surface facing the ladle body, and the metal support is provided with a protection plate for ventilation openings under the opening at a distance from the opening. Therefore, molten metal cannot directly adhere to the gas-permeable fireproof material layer. The ladle for transferring molten metal may shake greatly when transferring or when preparing to pour molten metal. In such a case, molten metal tends to adhere to the gas-permeable fireproof material layer. The adhered molten metal may solidify and separate from the gas-permeable fireproof material layer while partially peeling the layer, which may then drop into the molten metal. Moreover, the adhered molten metal makes it difficult to flow pressurizing gas into the ladle body from the gas-permeable fireproof material layer. According to the ladle for transferring molten metal (9), since the metal support is provided with a protection plate under the ventilation opening, the protection plate can prevent the direct contact of molten metal with the gas-permeable fireproof material layer that is exposed at the ventilation opening. In addition, since molten metal does not easily adhere to the metal support, the work will proceed without any problem and the metal support is not likely to be damaged. Therefore, the ladle provides stable use over a long period of time.

According to the above-described ladle for transferring molten metal (10), the protection plate of the ladle for transferring molten metal (9) inclines downward from the center to the outside. Thus, even if molten metal drops such as splashes onto the protection plate, the molten metal drops will easily run down therefrom. Accordingly, molten metal is not likely to solidify and remain on the protection plate. In addition, even if the ladle for transferring molten metal is used with vigorous shaking, it can be used over a long period of time without causing any trouble.

According to the above-described ladle for transferring molten metal (11), a gas outlet for discharging gas from the ladle for transferring molten metal is provided on the working cover, which facilitates discharging gas. In particular, even if gas needs to be discharged urgently, operating mistakes can be avoided due to the simple operation.

According to the above-described molten-metal tapping method, molten metal is contained, transferred, and tapped using any one of the above-described ladles for transferring molten metals (1)-(11). Thus, pressurizing gas can be supplied to the ladle body with no difficulties, and molten metal can be poured reliably.

BRIEF DESCRIPTION OF THE DRAWINGS

FIG. 6A is a cross-sectional view thereof and FIG. 6B is a plan view thereof.

FIG. 7A is a cross-sectional view thereof and FIG. 7B is a plan view thereof.

FIG. 8A is a cross-sectional view thereof and FIG. 8B is a plan view thereof.

FIG. 10A shows the configuration of an edge part. FIG. 10B shows an attached part of a protection plate.

FIG. 13A shows an example in which a gas outlet is provided on a working cover consisted of a gas-permeable fireproof material layer. FIG. 13B shows an example in which a gas outlet is provided on a working cover comprised of a gas-permeable fireproof material layer and a heat-insulating material layer.

DETAILED DESCRIPTION OF THE INVENTION

Figure 1:
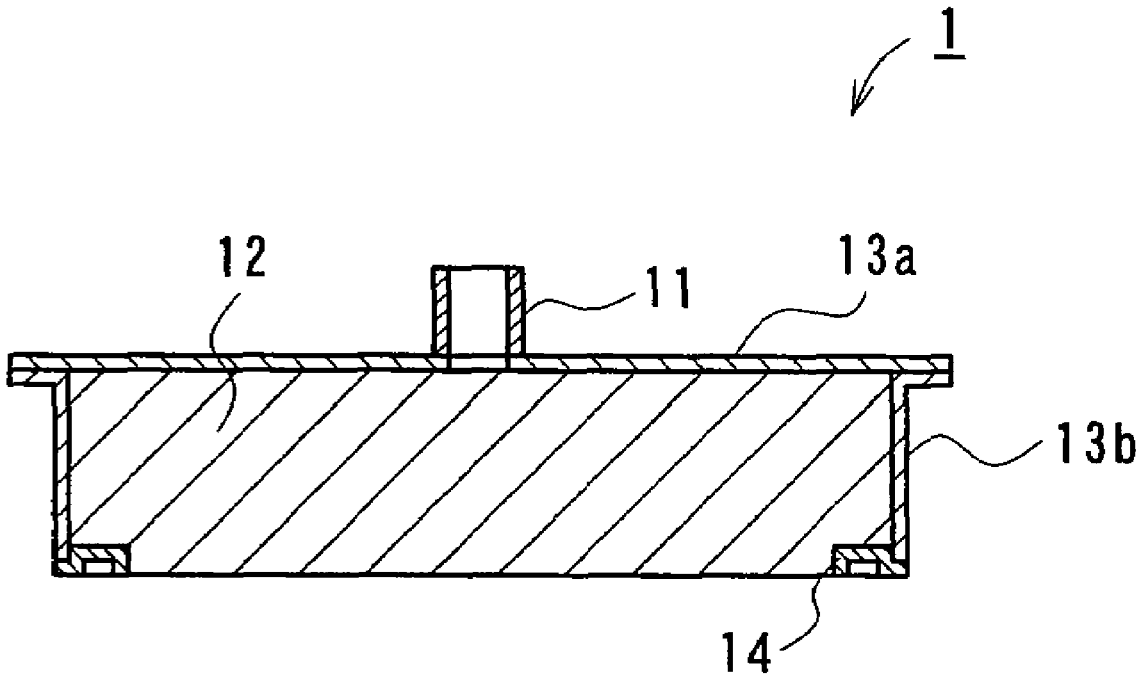
FIG. 1 is a cross-sectional view showing the configuration of a working cover for use in the ladle for transferring molten metal according to Embodiment (1).

The molten-metal transferring ladles according to embodiments of the present invention are described below with reference to the drawings. In each drawing, the same or similar parts are designated by the same reference numerals, and their descriptions may be omitted.

An embodiment of the targeted molten-metal transferring ladle of the invention is a pressure tapping type ladle for transferring molten metal. The configuration of the principal parts is almost the same as that of the conventional pressure tapping type ladle for transferring molten metal shown in FIGS. 14A and 14B according to one embodiment. In particular, the difference lies in the configuration of the working cover, and thus the working cover is mainly explained in detail.

Figure 14A:
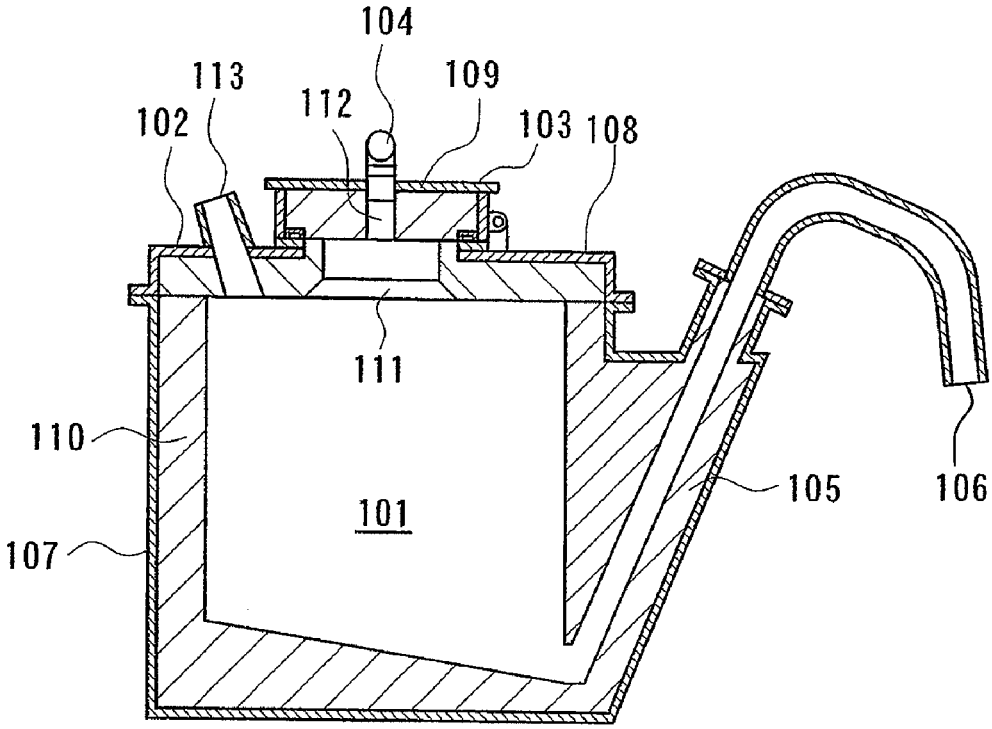
Fig.14A Prior Art
FIGS. 14A and 14B are cross sectional views showing an example of a conventional pressure tapping type ladle for transferring molten metal.
Figure 14B:
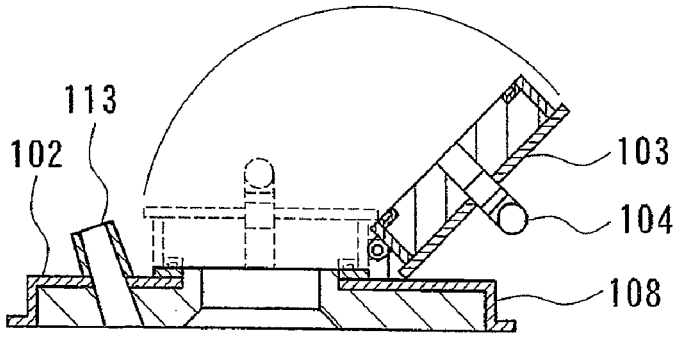

As shown in FIGS. 14A and 14B, the principal parts of the pressure tapping type ladle for transferring molten metal comprise: a ladle body 101 for containing molten metal; a top cover 102 covering a top opening of the ladle body; and an openable working cover 103 covering the opening formed in a part of the top cover 102. The working cover 103 is equipped with a cover body 109 covering the opening of the top cover 102 from above, a gas inlet 104, formed in a top panel of the cover body 109 for introducing gas for pressurizing the molten metal surface in the ladle, a heat-resistant layer provided inside the cover body 109, and a molten-metal tapping portion extending from a lower end portion of the ladle body 101 to above the ladle body 101. The outer surfaces of the ladle body 101 and the top cover 102 are configured with steel shells 107 and 108, respectively. A liner 110 comprised of a fireproof material alone or a combination of a fireproof material and a heat-insulating material is provided inside the steel shells 107 and 108 for the ladle body 101, the top cover 102, etc.

In most cases, the amount of molten metal contained in the ladle for transferring molten metal is about 1000 kgf. In such a case, the size of the ladle for transferring molten metal is as follows: the height from the bottom of the ladle body 101 to the working cover 103 is about 700 mm to about 1200 mm, the outer diameter of, for example, the top cover 102, is about 1000 mm to about 1400 mm, the inner diameter (the space defined by the liner 110) of the ladle body 101 is about 700 mm to about 1000 mm, and the depth is about 700 mm to about 1000 mm. With respect to the working cover 103, its outer diameter is about 500 mm and its thickness is about 100 mm to about 150 mm. The inside of the steel shell of the cover body 109 is laminated with, for example, a fireproof material having a thickness of about 25 mm to about 100 mm.

A heat-resistant (for example, carbon-based) sealing material, etc., is used to seal substantially between the ladle body 101 and the top cover 102 as well as the top cover 102 and the working cover 103. This sealing is sufficient to allow the ladle inside to stand the pressure applied when molten metal is poured, i.e., about $6\times10^4$ Pa (about 0.6 kgf/cm$^2$) (gauge pressure, maximum). Moreover, a certain amount of gas leakage is acceptable insofar as the control of the pressure inside the ladle is not hindered. The tapping portion 105 is not limited to the type shown in FIGS. 14A and 14B, and any type of tapping portion can be used insofar as it can be applied to the pressure tapping type ladle for transferring molten metal.

FIG. 1 is a cross-sectional view of the configuration of the working cover for use in the ladle for transferring molten metal according to Embodiment (1) of the invention. The working cover 1 shown in FIG. 1 is equipped with a gas inlet 11 and a gas-permeable fireproof material layer 12, which is a heat-resistant layer. The upper side and the side walls of the working cover 1 are made of steel shells 13*a* and 13*b*, respectively, and a ring-like sealing member 14 is joined to the bottom end of the steel shell 13*b* of the side walls.

Between the gas inlet 11 and a gas supply unit (not shown) is provided a pressure controller (not shown) for controlling the pressure in the molten-metal transferring ladle. If required, by providing a valve for switching the mode between gas introduction and gas discharge, the pressure controller may be provided with a function of discharging the gas in the molten-metal transferring ladle through the gas inlet 11. In most cases, air is used as the pressurizing gas, but an inert gas, such as nitrogen gas, argon gas, etc., may also be used.

Figure 2A:
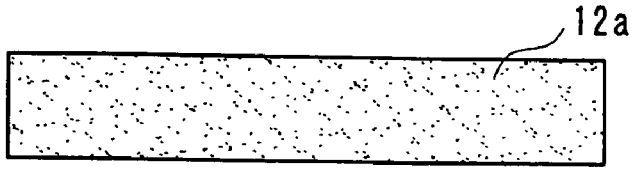
FIGS. 2A to 2E are cross-sectional views specifically showing the construction of a gas-permeable fireproof material layer.

FIGS. 2A to 2E are cross-sectional views showing a specific construction of the gas-permeable fireproof material layer 12. FIG. 2A shows that the gas-permeable fireproof material layer 12 is wholly comprised of a gas-permeable porous fireproof material layer 12*a*, such as an alumina, mullite (silica-alumina), silica, or calcium silicate-based porous sintered material having fine pores with a diameter of about 1 mm or less, for example. These porous sintered materials have comparatively low gas permeability.

Figure 2B:
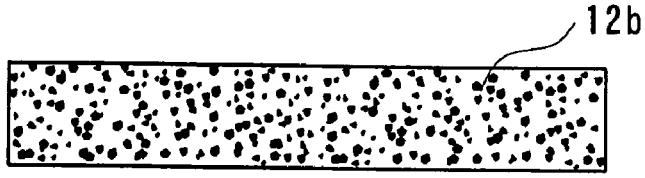

FIG. 2B shows one example of the gas-permeable fireproof material layer 12 in which gas flows through the gaps of an interlaced framework or string-like materials. For example, the gas-permeable fireproof material layer 12 is wholly comprised of a porous material layer 12*b* with a three-dimensional framework structure which has a remarkably high porosity and continuous pores (e.g., trade name: "ceramic foam"). The porous material with a three-dimensional framework structure is also used as a filter for filtering impurities, such as oxides, which usually exist in molten aluminum or aluminum alloy, and the gas permeability is noticeably high because the porosity is 80% to 90%. In addition, the porous material with a three-dimensional framework structure has high fire resistivity because it is comprised of, for example, an alumina-cordierite, alumina, or mullite-based fireproof material. Accordingly, the porous material of a three-dimensional framework structure is preferable as the gas-permeable fireproof material layer 12*b*.

A gas-permeable string-pack sintered material in which string-like fireproof materials are packed and sintered is mentioned as one example in which gas flows through the gaps of string-like materials. This string-like fireproof material is also preferable as the gas-permeable fireproof material layer 12*b*. Furthermore, a gas-permeable-fiber formed object obtained by forming fireproof fibers into a board shape is mentioned, and is preferable as the highly gas-permeable fireproof material layer 12*b*.

Figure 2C:
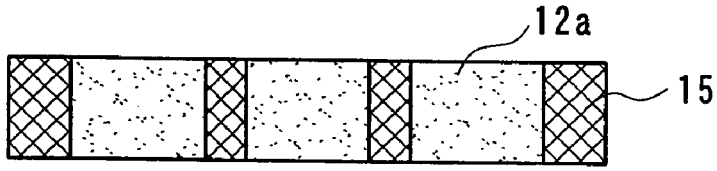
Figure 2D:
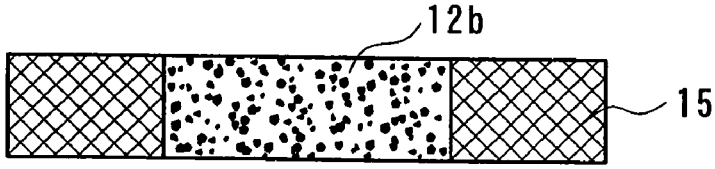

FIG. 2C shows that the gas-permeable fireproof material layer 12 is comprised of a porous fireproof material layer 12*a* and a non-gas-permeable fireproof material layer 15. FIG. 2D shows an example of the gas-permeable fireproof material layer 12 that is comprised of a porous material layer 12*b* with a three-dimensional frame structure and a non-gas-permeable fireproof material layer, such as a castable refractory and a fireproof brick 15. As shown in FIGS. 2C and 2D, the whole area of the gas-permeable fireproof material layer 12 is not necessarily comprised of a gas-permeable fireproof material layer. The gas-permeable fireproof material layer 12 is necessary to have gas permeability as the whole material layer. However, it is preferable to determine a proportion of the area of the non-gas-permeable fireproof material layer 15 that will ensure gas permeability even if the layer is partially clogged by the splash of molten metal, etc.

When the gas-permeable fireproof material layer 12 is partially non-gas-permeable as shown in FIGS. 2C and 2D, it is preferable to provide a space that serves as a header for a gas reservoir, which is described later, between the gas-permeable fireproof material layer 12 and the gas inlet 11.

Figure 2E:
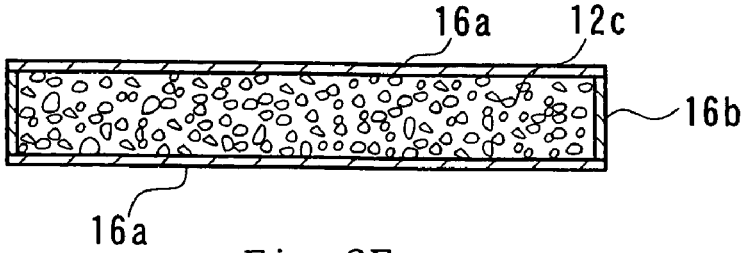

FIG. 2E shows an example of a fireproof material layer 12*c* in which the gas-permeable fireproof material layer 12 is comprised of spheres produced from, for example, an alumina, mullite (silica-alumina), or calcium silicate-based fireproof material. This fireproof material layer 12*c* is provided with two gas-permeable holding members 16*a* for holding a given thickness of the sphere-bearing layer of the fireproof material and gas-permeable side wall members 16*b* for holding the two holding members 16*a* at a predetermined interval.

The holding member 16*a* has gas permeability and is comprised of a net-like or plate-like metallic material with many holes. A heat-resistant or oxidation-resistant metallic material, such as a Cr—Mo, or stainless steel-based steel material, etc., is suitable for the holding member 16*a* or the side wall member 16*b*. Moreover, the mesh opening and the hole diameter are determined so that the spheres of fireproof material will not leak out. In order to ensure moderate gas permeability, the sphere size of the fireproof material is preferably within the range of about 5 mm to about 20 mm in diameter.

The spheres of the fireproof material need not be held directly by the holding member 16*a*, and may be covered with a sheet-like permeable fireproof material and then held by the holding member 16*a* through the sheet-like fireproof material. In that case, the mesh opening and the hole diameter of the holding member can be made larger than the sphere diameter of the fireproof material. In addition, although the above description is given to the case where the fireproof material is comprised of spheres, the shape is not limited to a spherical shape. Any shape other than spherical, such as a square shape, an amorphous shape, etc., is acceptable insofar as there are gaps between grains.

The thickness of the permeable fireproof material layer 12 shown in FIGS. 2A-2E is about 25 mm to about 100 mm as described above.

Figure 3:
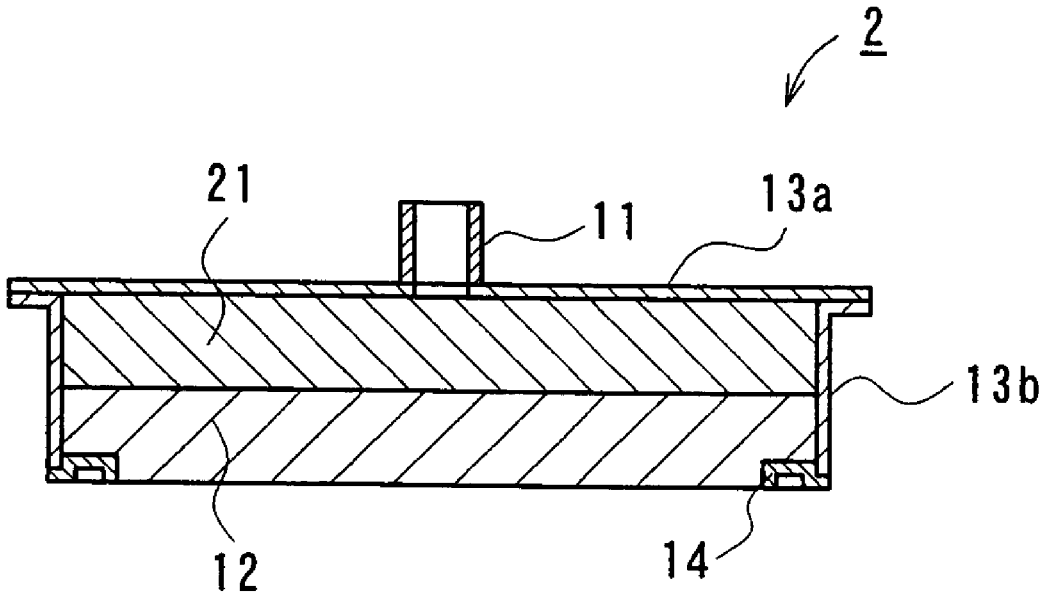
FIG. 3 is a cross-sectional view showing the configuration of a working cover for use in the ladle for transferring molten metal according to Embodiment (2).

FIG. 3 is a cross-sectional view of the configuration of a working cover 2 for use in the molten-metal transferring ladle according to Embodiment (2) of the invention. The heat-resistant layer shown in FIG. 3 comprises the same gas-permeable fireproof material layer 12 as in the above-described working cover 2 described with reference to FIG. 1 and FIG. 2, and the difference therebetween lies only in the thickness of the gas-permeable fireproof material layer 12. Thus, a detailed description is omitted.

The working cover 2 shown in FIG. 3 is comprised of a gas-permeable heat-insulating layer 21 between the gas inlet 11 and the gas-permeable fireproof material layer 12. Any material can be used as the gas-permeable heat-insulating layer 21 insofar as the material has heat resistivity up to about 800° C., gas permeability, and insulation properties. For example, a porous material shaped into a plate-like form or a block-like form or a fiber material obtained by forming fiber (short fibers) into a board or a sheet (e.g., trade name: "kaowool", etc.).

The thickness relation between the gas-permeable fireproof material layer 12 and the gas-permeable heat-insulating layer 21 vary depending on the design and according to the insulation efficiency of the entire layer, the thermal conductivity of the gas-permeable fireproof material layer 12 and the gas-permeable heat-insulating layer 21, the strength of each material, etc. Thus, the thickness of each layer is preferably determined according to the conditions thereof. However, in order to achieve a certain degree of heat insulating effect, the thickness of the gas-permeable heat-insulating layer 21 is preferably at least about 30 mm.

Figure 4:
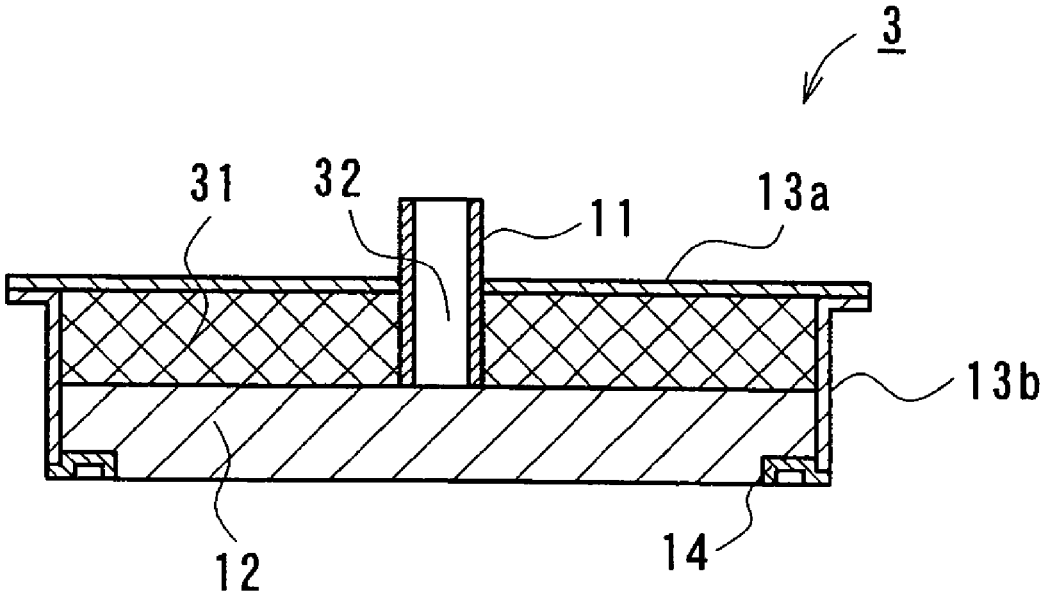
FIG. 4 is a cross-sectional view showing the configuration of a working cover for use in the ladle for transferring molten metal according to Embodiment (3).

FIG. 4 is a cross-sectional view showing the configuration of a working cover 3 for use in the molten-metal transferring ladle according to Embodiment (3) of the invention. Since the heat-resistant layer shown in FIG. 4 comprises the same gas-permeable fireproof material layer 12 as in the above-described working cover 1, and the difference therebetween lies only in the thickness of the gas-permeable fireproof material layer 12, a detailed description is omitted.

The working cover 3 shown in FIG. 4 is comprised of a heat-insulating layer 31 having a gas flow portion 32 between the gas inlet 11 and the gas-permeable fireproof material layer 12. The gas flow portion 32 is an opening formed in the heat-insulating material layer 31 for use in introducing pressurizing gas into the molten-metal transferring ladle and discharging gas from the molten-metal transferring ladle. Between the gas flow portion 32 and the molten-metal transferring ladle, gas flows through the gas-permeable fireproof material layer 12.

The heat-insulating layer 31 does not require gas permeability, and any material with heat resistivity up to about 800° C. and thermal insulation properties can be used. For example, a heat-insulating castable refractory and porous formed material, etc., can be used for the heat-insulating layer 31. In addition, the above-described gas-permeable fiber formed material (e.g., trade name: "kaowool", etc.) can also be used.

The thickness relations between the gas-permeable fireproof material layer 12 and the gas-permeable heat-insulating layer 31 vary depending on the design and according to the insulation efficiency of the entire layer, the thermal conductivity of the gas-permeable fireproof material layer 12 and gas-permeable heat-insulating layer 31, the strength of each material, etc. Thus, the thickness is preferably determined according to the conditions thereof. However, in order to achieve a certain degree of heat insulating effect, the thickness of the gas-permeable heat-insulating layer 31 is preferably at least about 30 mm.

Figure 5A:
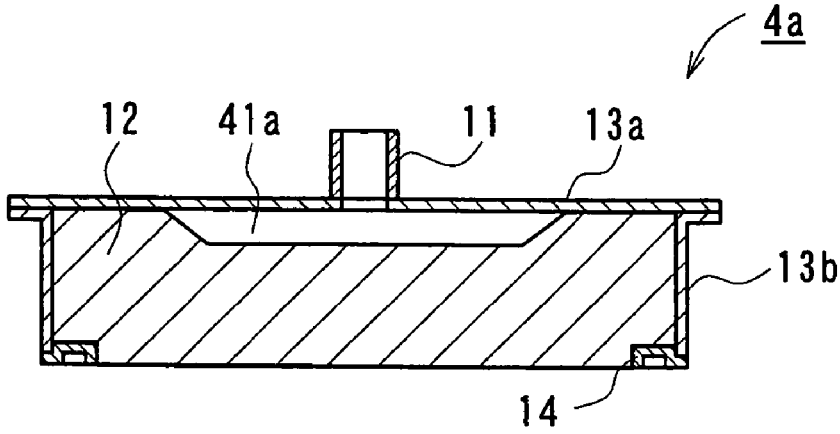
FIGS. 5A to 5C are cross-sectional views showing the configuration of a working cover for use in the ladle for transferring molten metal according to Embodiment (4).
Figure 5B:
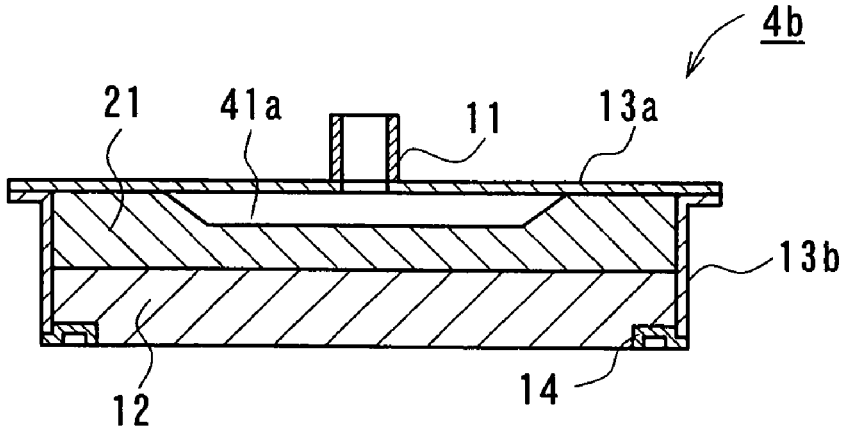
Figure 5C:
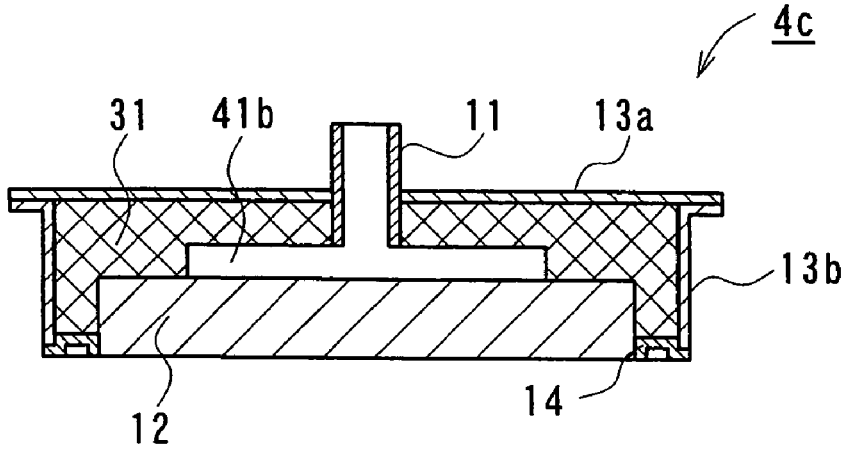

FIGS. 5A to 5C are cross-sectional views of the configuration of the working cover for use in the molten-metal transferring ladle according to Embodiment (4) of the invention. The working covers 4*a* (FIG. 5A), 4*b* (FIG. 5B), and 4*c* (FIG. 5C) shown in FIGS. 5A to 5C correspond to the working cover 1 shown in FIG. 1, the working cover 2 shown in FIG. 3, and the working cover 3 shown in FIG. 4, respectively. However, there is a difference in that spaces 41*a* and 41*b*, which serve as an introduction gas reservoir, are disposed between the gas-permeable fireproof material layer 12 or the gas-permeable heat-insulating layer 21 and the gas inlet 11. In the case of the working cover 4*c* shown in FIG. 5C, since the heat-insulating layer 31 is non-gas-permeable, the space 41*b* is disposed between the gas-permeable fireproof material layer 12 and the heat-insulating layer 31.

The area of the spaces 41*a* and 41*b* does not have to be the same as the entire surface of the gas-permeable fireproof material layer 12 or the gas-permeable heat-insulating layer 21. However, it is preferable to enlarge the space when the gas permeability of the gas-permeable fireproof material layer 12 or the gas-permeable heat-insulating layer 21 is low. For example, when a layer with low gas permeability, such as a porous sintered material (FIG. 2A, for example), is used, it is preferable to determine, according to the gas permeability, the space area relative to the area of the gas-permeable fireproof material layer 12 or the gas-permeable heat-insulating layer 21. Each height (thickness) of the spaces 41*a* and 41*b* is preferably within a range of about 5 mm to about 20 mm.

These spaces 41*a* and 41*b* are especially effective when the gas permeability of the gas-permeable fireproof material layer 12 alone or the combination of the gas-permeable heat-insulating layer 21 and the gas-permeable fireproof material layer 12 is low. More specifically, by enlarging the area of the gas-permeable fireproof material layer 12 or the gas-permeable heat-insulating layer 21 facing the space 41*a* or 41*b*, the flow rate of gas introduced into the molten-metal transferring ladle or gas discharged from the molten-metal transferring ladle can be increased.

Figure 6A:
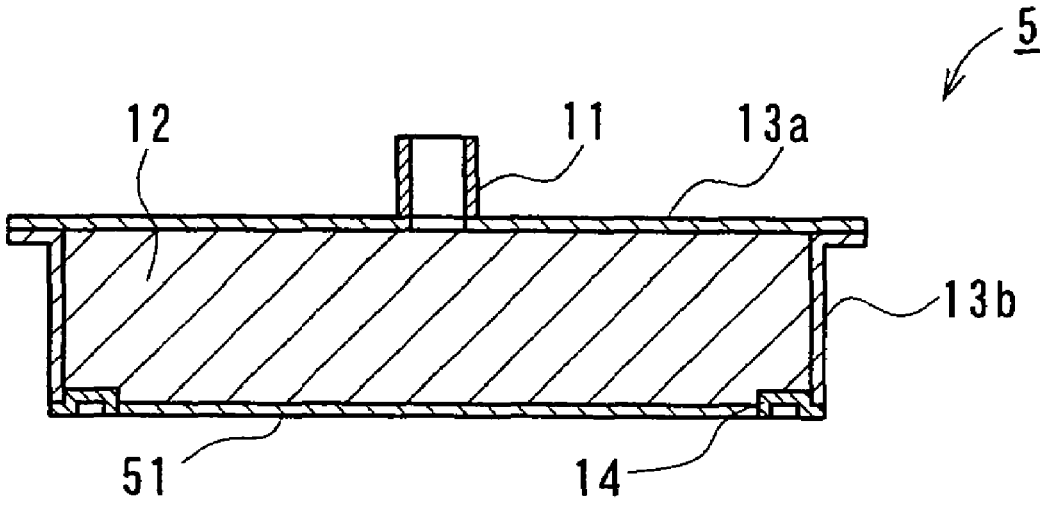
FIGS. 6A and 6B are views showing the configuration of a working cover for use in the ladle for transferring molten metal according to Embodiment (5).
Figure 6B:
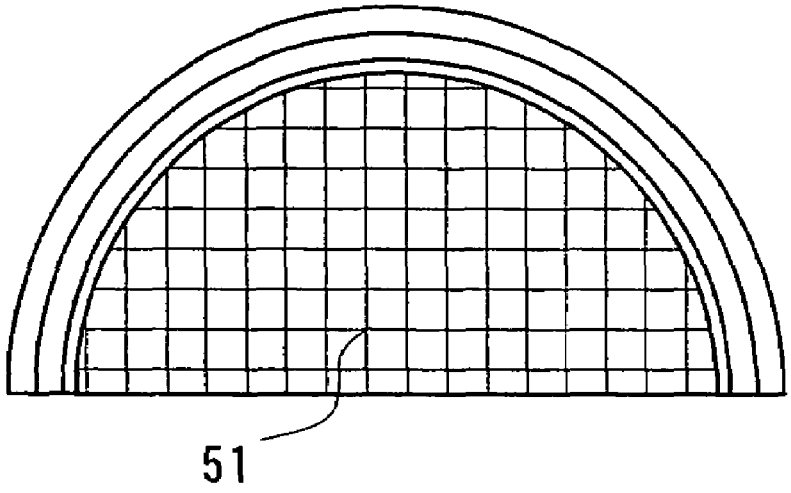

FIGS. 6A and 6B are cross sectional views of the configuration of the working cover for use in the molten-metal transferring ladle according to Embodiment (5) of the invention. The working cover 5 shown in FIG. 6 is provided with a metal support 51 on the undersurface of the gas-permeable fireproof material layer 12. The metal support 51 has the effect of preventing the fall of the gas-permeable fireproof material layer 12 and supporting the gas-permeable fireproof material layer 12*c* comprised of spherical fireproof materials shown in FIG. 2E. The metal support 51 is preferably attached inside the sealing member 14 so as not to damage the sealing between the top cover 102 and each of the working covers 1 to 3 and 4*a* to 4*c*.

For the above-described metal support 51, a wire net, lattice bar steel, metal plate with many holes, and the like are preferable because the gas will then flow between the gas-permeable fireproof material layer 12 and the ladle body 101 without any trouble. Suitable as a metallic material for the metal support 51 are a heat-resistant and oxidation-resistant steel material, such as a Cr—Mo or stainless steel-based metallic material.

Figure 7A:
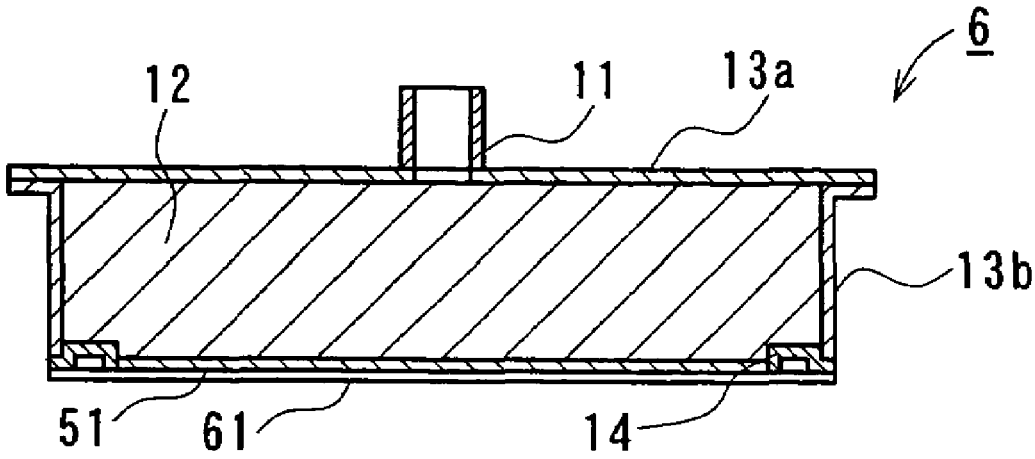
FIGS. 7A and 7B are views showing the configuration of a working cover for use in the ladle for transferring molten metal according to Embodiment (6).
Figure 7B:
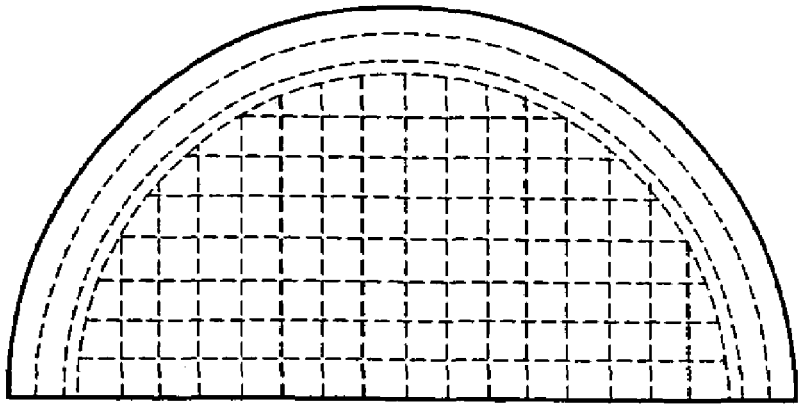

FIGS. 7A and 7B are cross sectional views of the configuration of the working cover for use in the molten-metal transferring ladle according to Embodiment (6) of the invention. The working cover 6 shown in FIG. 7 is provided with a gas-permeable fireproof material cover 61 on the undersurface (facing the ladle body 101) of the metal support 51 in the working cover 5 according to the above-described embodiment (5). This gas-permeable fireproof material cover 61 prevents damage to the metal support 51 caused by the adhesion of molten aluminum or aluminum alloy. Ordinarily, a brittle intermetallic compound tends to generate due to the alloying of aluminum and iron. Therefore, the durability of the metal support 51 can be improved by preventing the direct adhesion of molten metal, such as aluminum, to the metal support 51.

A nonwoven sheet formed of glass fiber or the like is suitable for the gas-permeable fireproof material cover 61. A heat insulating cloth, etc., is used industrially, and any material can be used as the gas-permeable fireproof material cover 61. It is not absolutely necessary to attach the gas-permeable fireproof material cover 61 to the working cover 6. The nonwoven sheet may be held between the top cover 102 and the working cover. Since the gas-permeable fireproof material cover 61 is needed especially when conveying the molten-metal transferring ladle containing molten metal, the cover 61 may be used only during the conveyance.

Figure 8A:
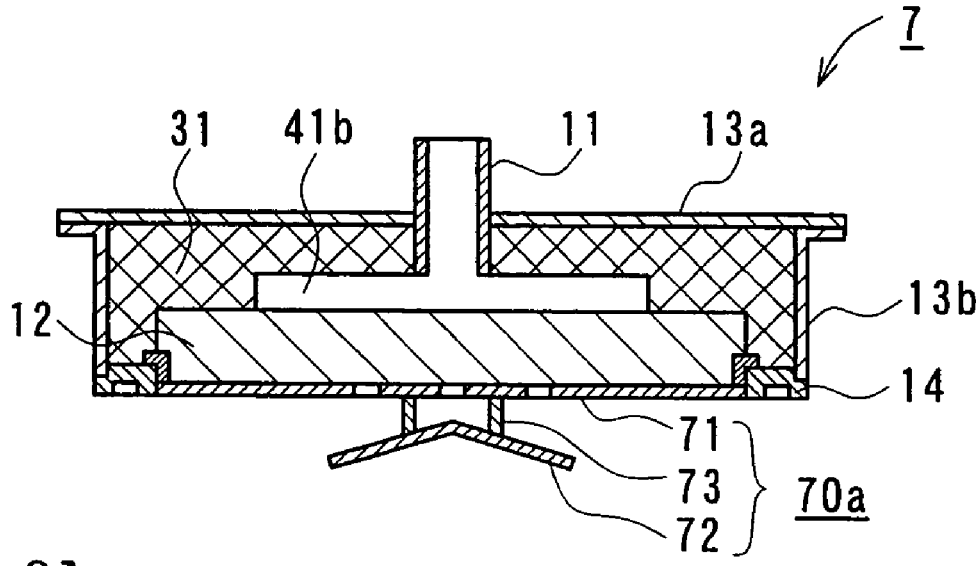
FIGS. 8A and 8B is views showing the configuration of a working cover for use in the ladle for transferring molten metal according to Embodiment (7).
Figure 8B:
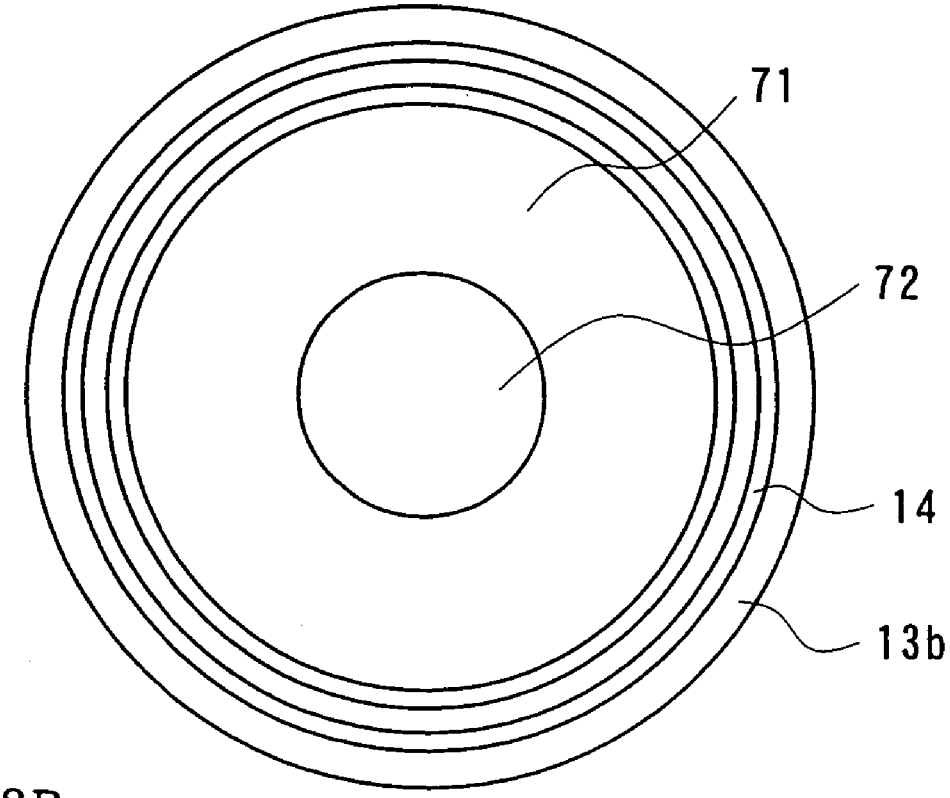

FIGS. 8A and 8B show the configuration of the working cover for use in the molten-metal transferring ladle according to Embodiment (7) of the invention. FIG. 8A is a cross sectional view thereof and FIG. 8B is a plan view as viewed from the bottom. The working cover 7 shown in FIGS. 8A and 8B is provided with a metal support 70*a* on the undersurface of the gas-permeable fireproof material layer 12 in the working cover 4*c* according to the above-described embodiment (4). The metal support 70*a* is comprised of a body 71, a protection plate 72 for ventilation openings (hereafter referred to as "protection plate"), and a fixing member 73 for fixing the protection plate 72 to the body 71. Although FIG. 8 shows an example in which the metal support 70*a* is attached to the working cover 4*c* according to Embodiment (4), the metal support 70*a* can be attached to any of the working covers according to Embodiments (1) to (4).

Figure 9:
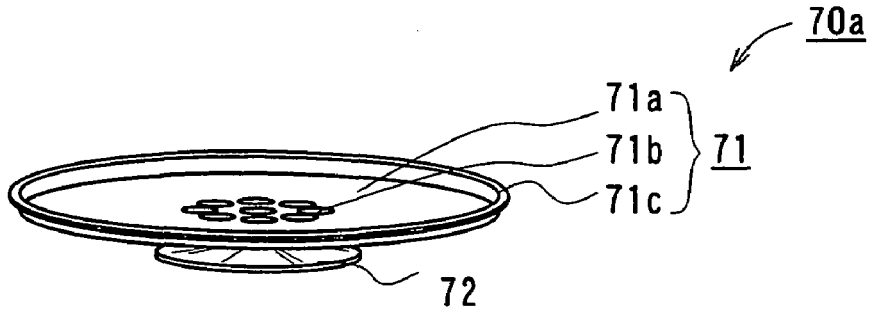
FIG. 9 is a perspective view showing a metal support constituting the working cover for use in the ladle for transferring molten metal according to Embodiment (7).
Figure 10A:
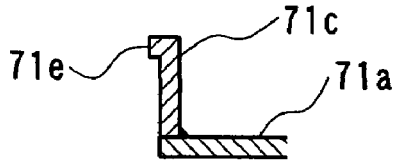
FIGS. 10A and 10B are partially enlarged cross-sectional views showing a part of the metal support constituting the working cover for use in the ladle for transferring molten metal according to Embodiment (7).
Figure 10B:
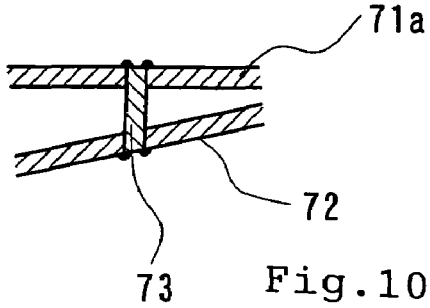

FIG. 9 is a perspective view of the metal support 70*a*. FIGS. 10A and 10B are partially enlarged cross sectional views of a part of the metal support 70*a*. FIG. 10A shows an edge 71*c* of the body 71, and FIG. 10B shows a fixing part of the fixing member 73.

As shown in FIG. 9, the body 71 is provided with a base plate 71*a* and an edge 71*c*. On the base plate 71*a*, a plurality of ventilation openings 71*b* are formed. The protection plate 72 is located under and separated from the ventilation openings 71*b*. The size of the plate corresponds to the region where the ventilation openings 71*b* are formed.

The ventilation opening 71*b* is an opening for flowing gas passing through the gas-permeable fireproof material layer 12 into the ladle and are formed near the central part of the base plate 71*a*. It is preferable to form two or more ventilation openings 71*b*, but a plurality of openings are not absolutely necessary and one opening may be sufficient. The size of each ventilation opening 71*b* is favorably determined according to the space capacity of the upper part of the molten metal body, the flow rate of pressurizing gas, the number of ventilation openings 71*b*, etc.

It is preferable that the protection plate 72 inclines downward from the central part to the outside, and is almost in the shape of an ancient soldier's straw hat. The plate does not necessarily incline downwardly in a linear manner, and may incline downwardly in a curved manner or the like. The plate inclining downwardly from the central part to the outside as described above facilitates dropping and flowing molten metal splashed on the protection plate 72 from the plate. The upper limit of the size (diameter) of the protection plate 72 is favorably determined so as to provide at least about a 20 mm gap between the opening 111 of the ladle (FIGS. 14A and 14B) and the protection plate 72 when the working cover 7 is placed on the ladle.

The body 71 and the protection plate 72 may be connected to each other by the fixing member 73. FIG. 10B shows an example of a fixing manner using the fixing member 73. FIG. 10B shows a favorable fixing method in which openings are formed in the base plate 71*a* and the protection plate 72, and then a bar-like fixing member 73 is inserted in each openings, and connected by welding, etc.

As shown in FIG. 10A, a projection 71*e* is desirably formed in an edge 71*c* of the body 71. This projection 71*e* is used for precise positioning while attaching the body 71 to the working cover 7. The working cover 7 shown in FIGS. 8A and 8B is assembled by, for example, inserting the support member 70*a* into the ring-like sealing member 14 prior to attaching the steel shell 13*a* and embedding the heat-insulating material layer 31, the gas-permeable fireproof material layer 12, etc. In this case, the support member 70*a* is pushed into the sealing member 14 from above the sealing member 14 in such a manner that the outer surface of the edge 71*c* of the support member 70*a* touches the inner surface of the sealing member 14. When the projection 71*e* is pressed until it reaches the upper surface of the sealing member 14, the support member 70*a* and the base plate 71*a* can be correctly positioned relative to the under surface of the sealing member 14.

Figure 11:
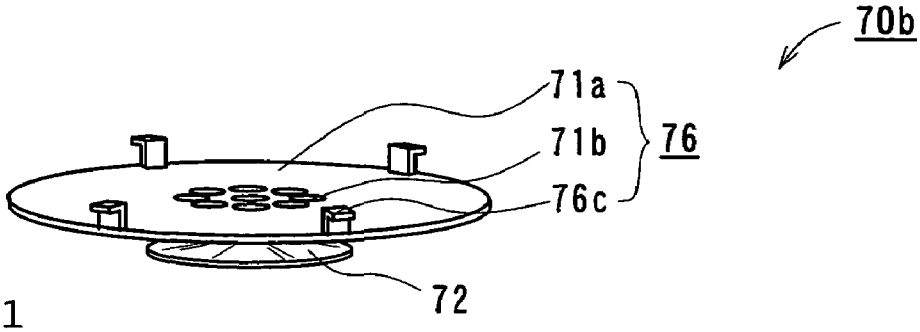
FIG. 11 is a perspective view showing another embodiment of the metal support constituting the working cover for use in the ladle for transferring molten metal according to Embodiment (7).

FIG. 11 is a perspective view showing a support member according to another embodiment. FIG. 11 shows an example of a support member 70*b* that has a different edge 71*c* from the support member 70*a* shown in FIG. 9. The support member 70*b* is provided with two or more edges 76*c* having a narrow circumferential width. Thus, the edge is not necessarily in a ring shape as shown in FIG. 9.

Figure 12:
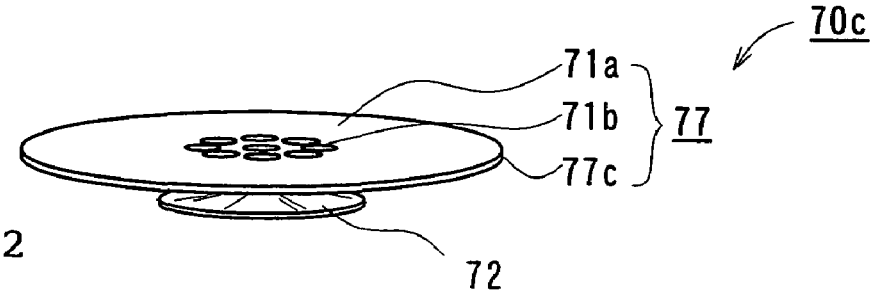
FIG. 12 is a perspective view showing still another embodiment of the metal support constituting the working cover for use in the ladle for transferring molten metal according to Embodiment (7).

FIG. 12 is a perspective view of a support member according to still another embodiment. FIG. 12 shows an example of a different support member 70*c* from the support member 70*a* shown in FIG. 9 and the support member 70*b* shown in FIG. 11 in that the edge 71*c* or 76*c* is not provided. The edge 71*c* or 76*c* is not absolutely necessary. In the case of the support member 70*c* without the edge, the outer periphery 77*c* of the base plate 71*a* may be connected to the sealing member 14 by welding, or the like.

The base plate 71*a* and the protection plate 72 of each support member 70*a*, 70*b*, and 70*c* shown in FIGS. 8 to 12 are favorably comprised of a highly heat-resistant metallic material, such as chromium-based stainless steel, chromium-molybdenum-based steel, etc., so as to withstand the heat of molten metal contained in the ladle body. In view of high-temperature strength and strength as a support member, the thickness of the base plate 71*a* is preferably about 4 mm or more and the thickness of the protection plate 72 is preferably about 3 mm or more, for example.

The shape of the protection plate 72 provided in each support member 70*a*, 70*b*, and 70*c* is described with reference to a case where it inclines downwardly from the center to the outside. However, when the splashing of molten metal is not so severe, an almost flat-sheet-like protection plate may be employed.

Figure 13A:
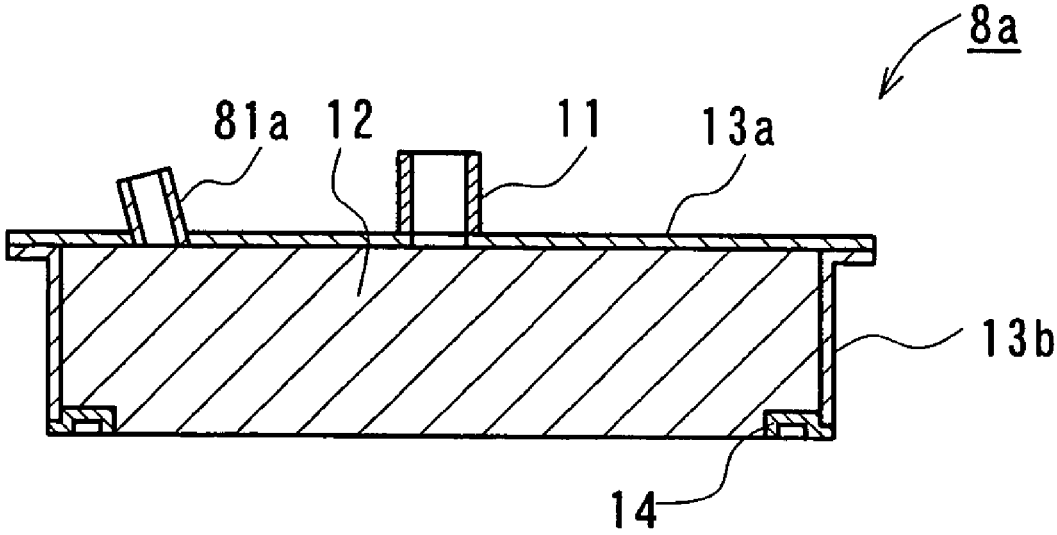
FIGS. 13A and 13B are cross-sectional views showing the configuration of a working cover for use in the ladle for transferring molten metal according to Embodiment (8).
Figure 13B:
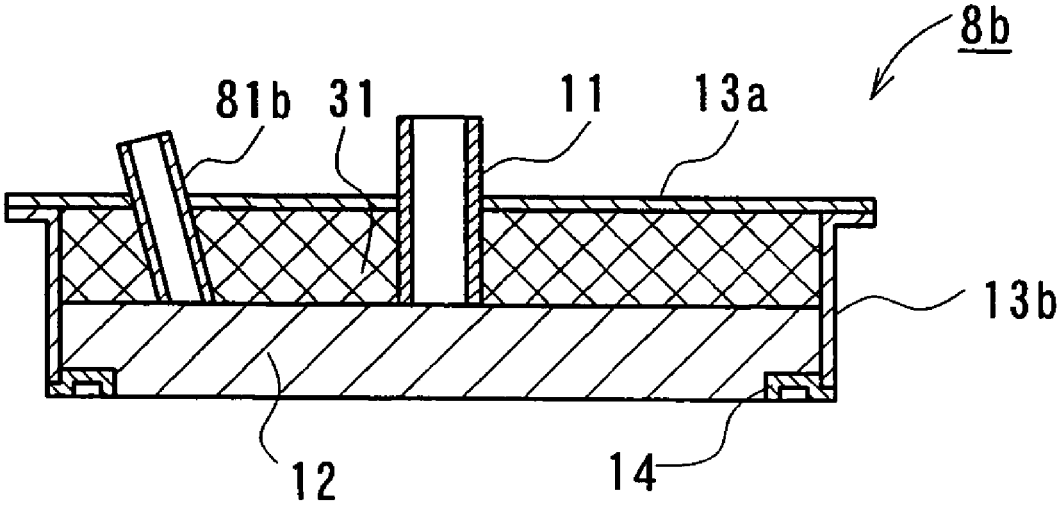

FIGS. 13A and 13B are cross-sectional views of the configuration of the working cover for use in the molten-metal transferring ladle according to Embodiment (7) of the invention. FIG. 13A is an example in which a gas outlet 81*a* is formed on a working cover 8*a* consisting of the gas-permeable fireproof material layer 12. FIG. 13B is an example in which a gas outlet 81*b* is formed on a working cover 8*b* comprised of the gas-permeable fireproof material layer 12 and the heat-insulating material layer 31.

In the gas outlet 81*a* shown in FIG. 13A, since the working cover 8*a* consists of the gas-permeable fireproof material layer 12, the gas outlet 81*a* opens on the upper surface of the gas-permeable fireproof material layer 12. In the gas outlet 81*b* shown in FIG. 13B, since the working cover 8*b* is comprised of the gas-permeable fireproof material layer 12 and the heat-insulating material layer 31, the gas outlet 81*b* opens both on the upper surface of the gas-permeable fireproof material layer 12 and on the under surface of the heat-insulating material layer 31.

As described above, gas in the molten-metal transferring ladle can be discharged from the gas inlet 11. However, in order to provide separate channels for introducing and discharging gas, it is preferable to form the gas outlets 81*a* and 81*b* in the positions shown in FIGS. 13A and 13B.

The pressure tapping type ladle for transferring molten metal of the invention prevents clogging of the opening for introducing gas to pressurize the inside of the ladle while transferring molten metal by, for example, a truck or like conveyance means. Therefore, pressurizing gas can be introduced reliably, and thus, molten metal is poured without any trouble, which leads to a stable tapping process for molten metal.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A pressure tapping type ladle for transferring molten-metal comprising:

a ladle body for containing molten metal;

a top cover covering a top opening of the ladle body;

an openable working cover covering an opening formed in a part of the top cover;

and a molten-metal tapping portion extending from a lower end portion of the ladle body to above the ladle body;

wherein the working cover is equipped with a cover body covering the opening of the top cover from above, a gas inlet formed in a top panel of the cover body, and a heat-resistant layer provided inside the cover body;

further wherein the heat-resistant layer consists of: a gas-permeable fireproof material layer; a gas-permeable fireproof material layer and a gas-permeable heat-insulating material layer between the gas-permeable fireproof material layer and the gas inlet; or a gas-permeable fireproof material layer and a heat-insulating material layer having a gas flow portion between the gas-permeable fireproof material layer and the gas inlet;

and yet further wherein the gas inlet is configured so as to allow gas for pressurizing inside the ladle body to be introduced from the gas inlet via the gas-permeable fireproof layer.

2. The molten-metal transferring ladle according to claim 1, wherein the working cover is provided with a space serving as a gas reservoir between the gas-permeable fireproof material layer and the gas inlet.

3. The molten-metal transferring ladle according to claim 1, wherein the working cover is provided with a space serving as a gas reservoir between the gas-permeable heat-insulating material layer and the gas inlet.

4. The molten-metal transferring ladle according to claim 1, wherein the working cover is provided with a space serving as a gas reservoir between the heat-insulating material layer having the gas flow portion and the gas-permeable fireproof material layer.

5. The molten-metal transferring ladle according to claim 1, wherein the working cover is provided, on the gas-permeable fireproof material layer surface facing the ladle body, with a metal support that supports the gas-permeable fireproof material layer and that has gas permeability.

6. The molten-metal transferring ladle according to claim 5, wherein the working cover is provided with a gas-permeable fireproof material cover covering the metal support on the metal support surface facing the ladle body.

7. The molten-metal transferring ladle according to claim 1, wherein the working cover is provided, on the gas-permeable fireproof material layer surface facing the ladle body, with a metal support that supports the gas-permeable fireproof material layer and that has an opening for ventilation, the metal support being provided, at a distance, with a plate for protecting the opening for ventilation under the opening for ventilation.

8. The molten-metal transferring ladle according to claim 7, wherein the plate for protecting the opening for ventilation inclines downward from the center to the outside.

9. The molten-metal transferring ladle according to claim 1, wherein the working cover is equipped with a gas outlet for discharging gas from the ladle body.

10. A method for tapping molten metal from a ladle for transferring molten-metal, comprising:

using a pressure tapping type ladle for transferring molten-metal, wherein the pressure tapping type ladle is comprised of a ladle body for containing molten metal, a top cover covering a top opening of the ladle body, an openable working cover covering an opening formed in a part of the top cover, and a molten-metal tapping portion extending from a lower end portion of the ladle body to above the ladle body; further wherein the working cover is equipped with a cover body covering the opening of the top cover from above, a gas inlet formed in a top panel of the cover body, and a heat-resistant layer provided inside the cover body, the heat-resistant layer consists of: a gas-permeable fireproof material layer; a gas-permeable fireproof material layer and a gas-permeable heat-insulating material layer between the gas-permeable fireproof material layer and the gas inlet; or a gas-permeable fireproof material layer and a heat-insulating material layer having a gas flow portion between the gas-permeable fireproof material layer and the gas inlet; and gas for pressurizing inside the ladle body is introduced from the gas inlet via the gas-permeable fireproof layer;

pouring molten metal into the ladle body of the molten-metal transferring ladle;

substantially sealing the ladle body with the top cover or the working cover; and introducing a pressurizing gas from the gas inlet via the gas-permeable fireproof material layer to pressurize the surface of the molten metal, thereby tapping molten metal from the molten-metal tapping portion.

11. A pressure tapping type ladle for transferring molten-metal comprising:

a ladle body for containing molten metal;

a top cover covering a top opening of the ladle body;

an openable working cover covering an opening formed in a part of the top cover; and a molten-metal tapping portion extending from a lower end potion of the ladle body to above the ladle body; wherein the working cover is equipped with a cover body covering the opening of the top cover from above, a gas inlet formed in a top panel of the cover body, a heat-resistant layer provided inside the cover body and a space serving as a gas reservoir between the heat-resistant layer and the gas inlet;

the heat-resistant layer consists of a gas-permeable and molten-metal splash impermeable fireproof material layer; and gas for pressurizing inside the ladle body is introduced from the gas inlet via the space and the gas-permeable and molten-metal splash impermeable fireproof layer.

12. A pressure tapping type ladle for transferring molten-metal comprising:

a ladle body for containing molten metal;

a top cover covering a top opening of the ladle body;

an openable working cover covering an opening formed in a part of the top cover;

and a molten-metal tapping portion extending from a lower end portion of the ladle body to above the ladle body;

wherein the working cover is equipped with a cover body covering the opening of the top cover from above, a gas inlet formed in a top panel of the cover body, a gas outlet formed in a top panel of the cover body and a heat-resistant layer provided inside the cover body;

further wherein the heat-resistant layer comprises a gas-permeable fireproof material layer;

and yet further wherein the gas inlet is configured so as to allow gas for pressurizing inside the ladle body to be introduced from the gas inlet via the gas-permeable fireproof layer and to allow for gas to be discharged from the ladle body through the gas outlet via the gas permeable fireproof layer.

13. The molten-metal transferring ladle according to claim 1, wherein the heat-resistant layer comprises the entire bottom surface of the working cover except for the lower end of the cover body.

14. The molten-metal transferring ladle according to claim 11, wherein the heat-resistant layer comprises the entire bottom surface of the working cover except for the lower end of the cover body.

* * * * *

UNITED STATES PATENT AND TRADEMARK OFFICE

CERTIFICATE OF CORRECTION

PATENT NO. : 7,354,547 B2
APPLICATION NO. : 11/331543
DATED : April 8, 2008
INVENTOR(S) : Ukaji et al.

It is certified that error appears in the above-identified patent and that said Letters Patent is hereby corrected as shown below:

On the title page item (54), under Assignees, delete "Nippon Crucible Co., Ltd., Tokyo (JP); Daiki Aluminum Industry Co. Ltd., Osaka (JP)" and insert -- Nippon Crucible Co., Ltd., Tokyo (JP); Daiki Aluminium Industry Co., Ltd., Osaka (JP) --, therefor.

Signed and Sealed this

Twenty-ninth Day of July, 2008

JON W. DUDAS
*Director of the United States Patent and Trademark Office*

UNITED STATES PATENT AND TRADEMARK OFFICE

CERTIFICATE OF CORRECTION

PATENT NO. : 7,354,547 B2
APPLICATION NO. : 11/331543
DATED : April 8, 2008
INVENTOR(S) : Ukaji et al.

It is certified that error appears in the above-identified patent and that said Letters Patent is hereby corrected as shown below:

On the title page item (73), under Assignees, delete "Nippon Crucible Co., Ltd., Tokyo (JP); Daiki Aluminum Industry Co. Ltd., Osaka (JP)" and insert -- Nippon Crucible Co., Ltd., Tokyo (JP); Daiki Aluminium Industry Co., Ltd., Osaka (JP) --, therefor.

This certificate supersedes the Certificate of Correction issued July 29, 2008.

Signed and Sealed this

Twenty-sixth Day of August, 2008

JON W. DUDAS
*Director of the United States Patent and Trademark Office*